US007303314B2

(12) United States Patent
Jones

(10) Patent No.: US 7,303,314 B2
(45) Date of Patent: Dec. 4, 2007

(54) ADJUSTABLE TRIM FOR SLOPED CEILING RECESSED DOWNLIGHT

(75) Inventor: Mark Owen Jones, South Dartmouth, MA (US)

(73) Assignee: Genlyte Thomas Group, LLC, Louisville, KY (US)

( * ) Notice: Subject to any disclaimer, the term of this patent is extended or adjusted under 35 U.S.C. 154(b) by 0 days.

(21) Appl. No.: 11/249,196

(22) Filed: Oct. 13, 2005

(65) Prior Publication Data

US 2006/0198126 A1 Sep. 7, 2006

Related U.S. Application Data

(60) Provisional application No. 60/658,681, filed on Mar. 4, 2005.

(51) Int. Cl.
*F21S 1/06* (2006.01)

(52) U.S. Cl. ..... 362/282; 362/283; 362/322; 362/365

(58) Field of Classification Search ..... 362/147, 362/148, 285, 287, 364–366, 372, 281, 282, 362/283, 322
See application file for complete search history.

(56) References Cited

U.S. PATENT DOCUMENTS

RE24,258 E 12/1956 Burliuk et al.
3,182,187 A 5/1965 Gellert
3,381,123 A 4/1968 Docimo
4,577,266 A 3/1986 Donato et al.
4,729,080 A 3/1988 Fremont et al.
5,452,193 A * 9/1995 Hinnefeld et al. ..... 362/366
5,457,617 A 10/1995 Chan et al.
5,562,343 A 10/1996 Chan et al.
5,630,663 A * 5/1997 Ling et al. ..... 362/365
5,823,664 A 10/1998 Demshki, Jr. et al.
6,234,644 B1 * 5/2001 Kotovsky et al. ..... 362/148
6,343,873 B1 2/2002 Eberhard et al.
6,402,112 B1 6/2002 Thomas et al.
D474,298 S 5/2003 Lecluze
6,779,908 B1 8/2004 Ng

* cited by examiner

*Primary Examiner*—Thomas M. Sember
(74) *Attorney, Agent, or Firm*—James E. Cole; Middleton Reutlinger

(57) ABSTRACT

A two piece adjustable trim for a sloped ceiling recessed downlight wherein the two piece trim has an upper element and a lower element hingedly connected to each other. A standard frame in housing may be utilized to receive the two piece rotatable trim, the trim and a lower element affixed to the mounting frame and pivotable relative to an upper trim element.

17 Claims, 9 Drawing Sheets

ADJUSTABLE TRIM FOR SLOPED CEILING RECESSED DOWNLIGHT

CROSS REFERENCE TO RELATED APPLICATIONS

This application claims the benefit of U.S. Provisional Application No. 60/658,681, filed Mar. 4, 2005, the entire disclosure of which is incorporated herein by reference.

BACKGROUND OF THE INVENTION

The present invention is related to recessed light fixtures and in particular recessed light fixtures that are installable on a sloped ceiling and that have adjustable two piece adjustable trim pieces for moveable aiming of the light within the fixture.

DESCRIPTION OF THE PREFERRED EMBODIMENT OF THE PRESENT INVENTION

Figure 1:
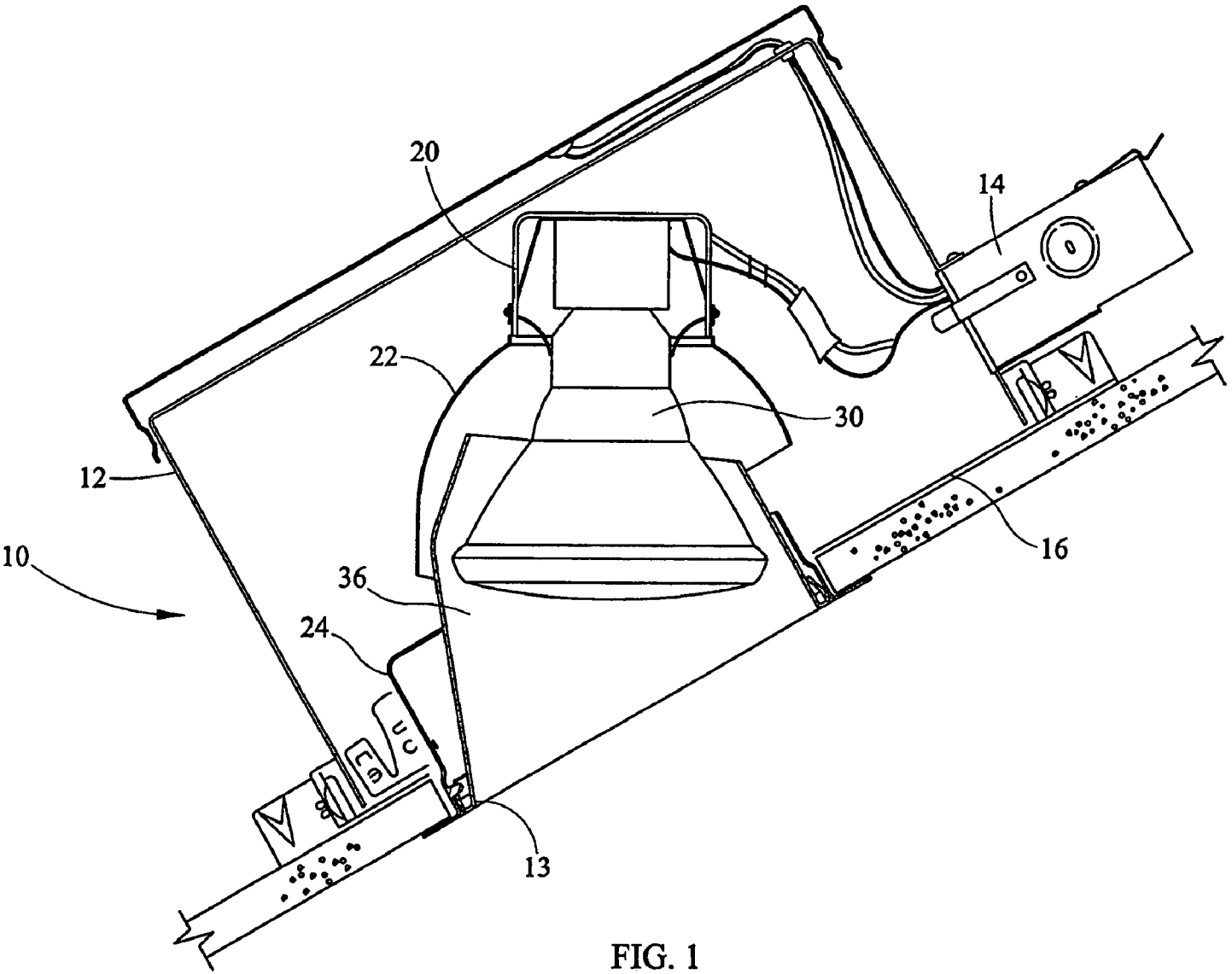
FIG. 1 is a side-sectional view of the adjustable trim for sloped ceiling recessed downlight of the present invention.

The recessed downlight 10 for a sloped ceiling is depicted in FIG. 1. As shown therein, the recessed downlight 10 has a housing 12 interior to which is located the lamp support structure and lamp. In instances where the recessed downlight must be aimed appropriately, in other words, situations where the center axis of the lamp 30 is not to be directly perpendicular to a plane defined by the pan or frame 16, it may be desirable to have the lamp pivotable or be able to swivel along a horizontal axis so that the light may be aimed perpendicular to the floor. In such instances as a sloped ceiling recessed light fixture, it may be desirable to have the center axis of the light be perpendicular to the illuminated surface, such as a floor, while not being perpendicular to the mounting surface, such as the ceiling. In those circumstances, rotation of the lamp 30 about a horizontal pivoting axis is desired without necessarily pivoting a support located on the pan or frame 16 or on the housing 12. As such, it is desirable to have a trim element which itself is designed to be rotatable about a horizontal axis to allow repositioning of the lamp and direction of the lamp center beam through an aperture 13 formed in the pan. Typically, the aperture formed in the pan will be circular as is depicted but any other aperture may likewise be utilized with the inventive two piece trim of the present invention.

Figure 3A:
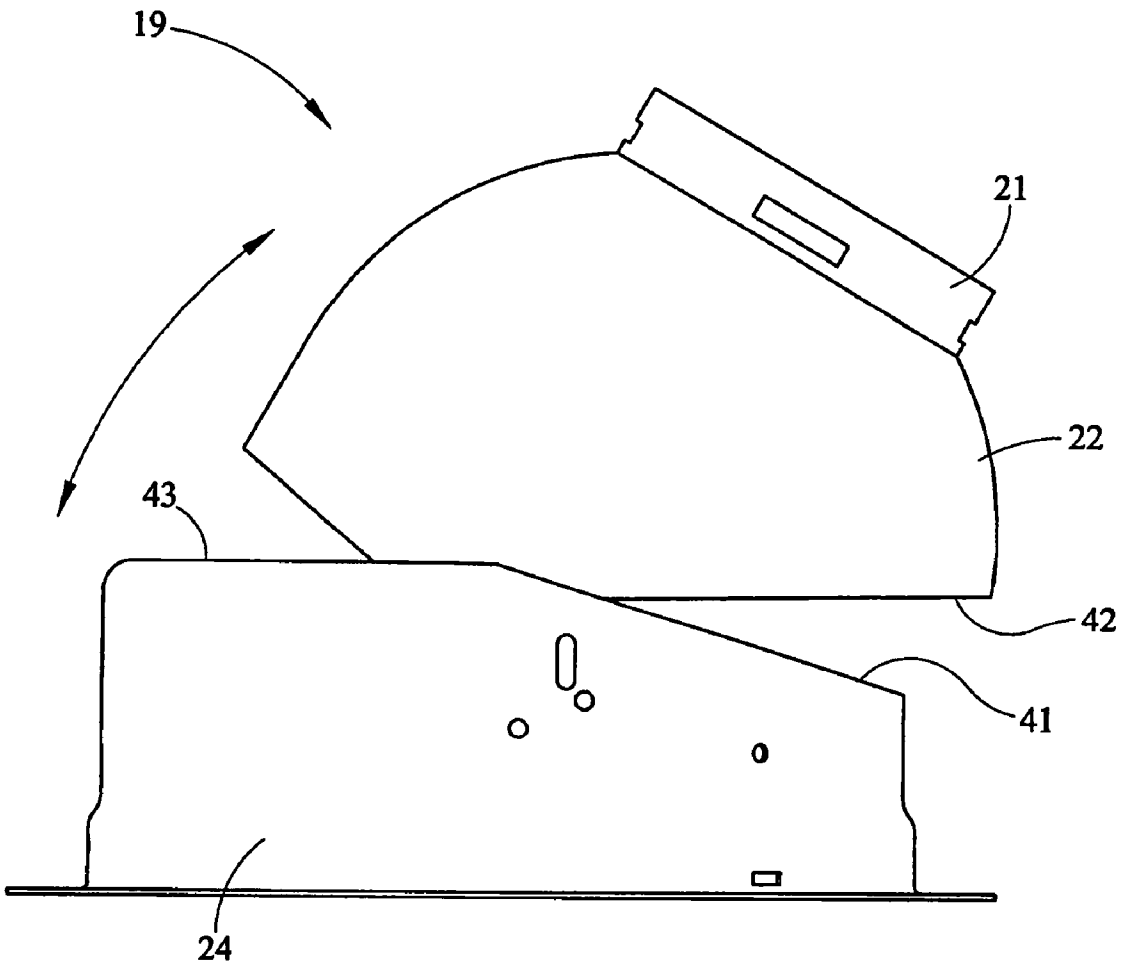
FIG. 3*a* is a side view of the two piece adjustable trim for installation in the recessed downlight of the present invention.
Figure 3B:
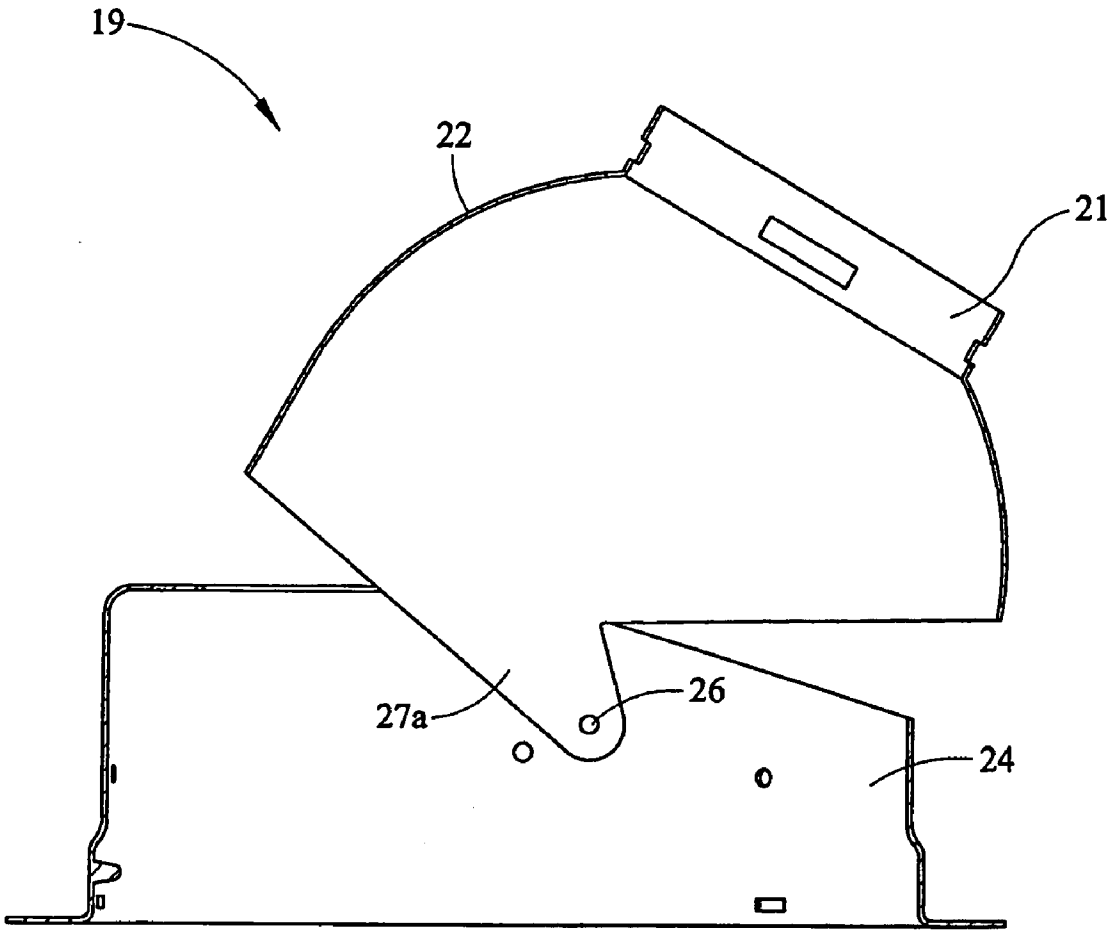
FIG. 3*b* is a side-sectional view of the two piece adjustable trim of FIG. 3*a;*

As depicted in the figures, the recessed downlight 10 of the present invention has a housing 12 which contains therein a two piece trim element 19 shown more clearly in FIGS. 3A and 3B. The two piece trim element 19 has an upper trim element 22 which is pivotally attached to a lower trim element 24. The lower trim element 24 is securely mechanically attached to the pan 16 so that the two piece trim structure is firmly retained within the housing 12.

Figure 5:
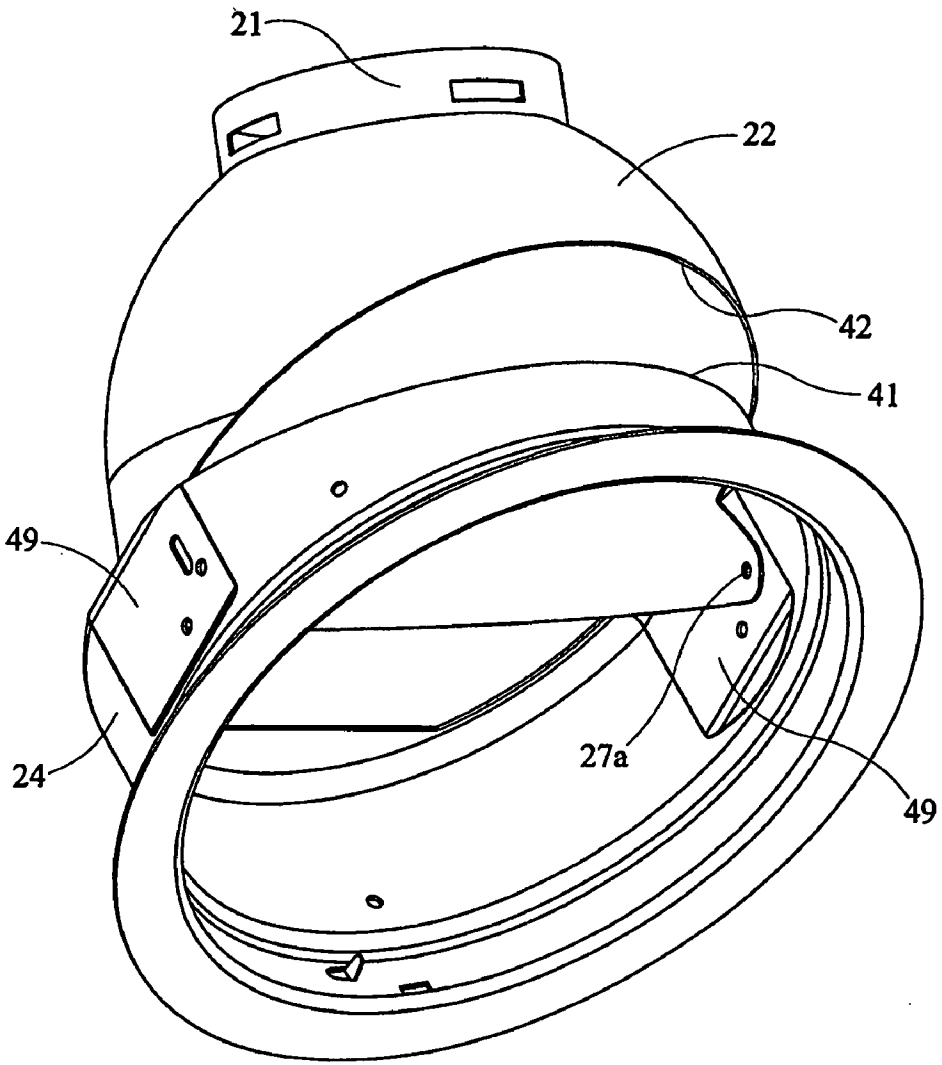
FIG. 5 is an isometric view of the interior of the two piece trim of the present invention; and, FIG. 6 is an isometric view of the interior of the two piece trim of the present invention.
Figure 6:
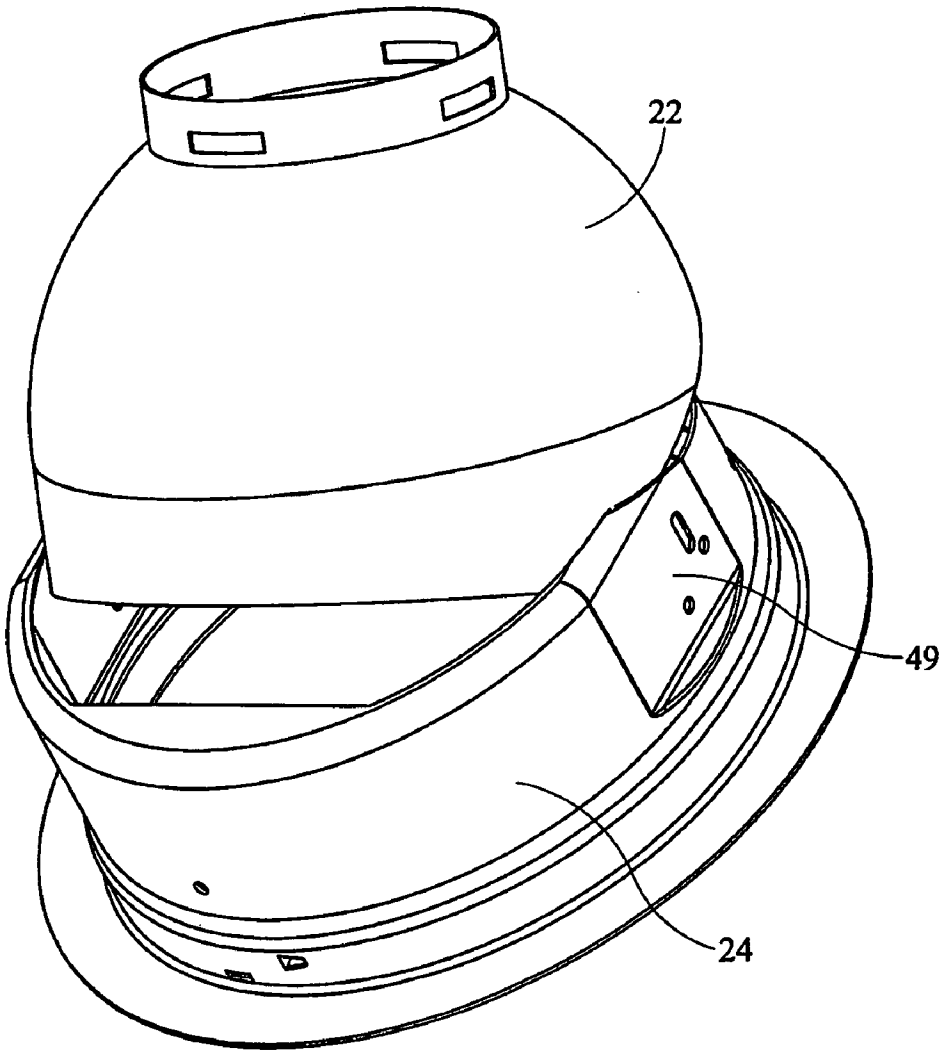

FIG. 5 depicts the two piece rotatable trim 19 of the present invention with an interior view of the hinge members. The upper trim element 22 may be described as a modified hemispherical section which rotates about a hinge 26. The modified hemispherical section 22 is designed such that a lamp fits therein and is held in place by socket cup 20. The modified hemispherical section 22 rotates on an interior hinge relative to lower trim element 24, the lower trim element 24 being substantially cylindrical in shape. The substantially cylindrical lower trim element 24 further has flat segments 49 which allows smooth operation of the hinges 26 allowing the legs 27A of the modified hemispherical section 22 to rotate within the interior perimeter of the lower trim element or cylindrical element 24. Of course, the design may be modified such that the modified hemispherical section or upper trim element 22 may be affixed to an exterior wall of the cylindrical sleeve or lower trim element 24 with appropriate design modifications. However, the two piece trim element 19 of the present invention incorporates the utilization of a rotatable upper section which is a modified hemispherical trim element and which is rotatably connected to a stationary lower trim element, the lower trim element possibly being substantially cylindrical in shape and receiving a hinge or pivot 10 interposing and hingedly connecting the two trim pieces. The ability therefore is provided such that a stationary lower trim element is affixed to a pan or other stationary object but aligned with the ceiling thereby allowing relative pivoting or rotational movement along an off center pin or hinge location allowing light to be redirected through an aperture formed in the lower trim element.

As shown in the figures, the lower trim element 24 is rotatably connected to the upper trim element 22. The upper trim element 22 is rotatably affixed to the lower trim element through first leg 27*a* and second leg 27*b* at hinge point 26. Hinge point 26 is created by rivets with spring or wavy washers in order to create a frictionalized rotation point thereby allowing positioning of the lamp as desired relative to the lower trim element 24.

Due to the design of the two piece rotatable trim 19 depicted herein, the two piece rotatable trim 19 may be installed directly into a standard frame-in housing kit without the necessity of being supported by any other internal structure within the housing 12. The upper trim element 22 and lower trim element 24 pivot relative to each other without any contact to the housing 12 or the support pan 16 apart from the mechanical affixation of the lower trim element 24 to the pan aperture ring 13.

Preferably due to installation requirements for a rotatable trim piece, the two piece rotatable trim 19 is rotatable relative to each other between about 10° and 50° and more preferably will accommodate rotation from 14° to 45° on a 3/12 to 12/12 pitch ceiling. In order to accommodate such rotational capability within a standard frame-in kit and housing 12, the two piece rotatable trim 19 has a hinge 26 which is an off center pivoting point. This offset hinge 26 located on either side of the lower trim piece 24 has a offset hinge point which is greater than about ⅝" offset from the center line. In other words, as opposed to the hinge points 26 being 180° apart on the lower trim piece 24, the hinge points may be approximately 155° apart more or less, depending on trim design. Such positioning of the pivotal hinge point 26 between the lower trim element 24 and upper trim element 22 allows the trim to be rotated along a wide path as indicated and allows the two piece trim element 19 to be installed within a standard frame in housing 12.

As indicated, the upper trim element 22 and lower trim element 24 may be interconnected along a hinge point 26 on either side. The hinge points may be placed on the interior wall of the lower trim element 24 allowing the upper trim element to swivel interiorly or may be alternatively placed depending on design characteristics, such as exteriorly. The hinge 26 as previously indicated may be formed from a loosely applied rivet as is known in the art with a wavy washer or spring washer. The pivot point and riveting mechanism may be of any rotatable interfacing technique known in the art and will provide sufficient resistance or frictional engagement to allow the upper trim element 22 and lamp 30 to be aimed appropriately as desired by the user once installed within housing 12.

Figure 2A:
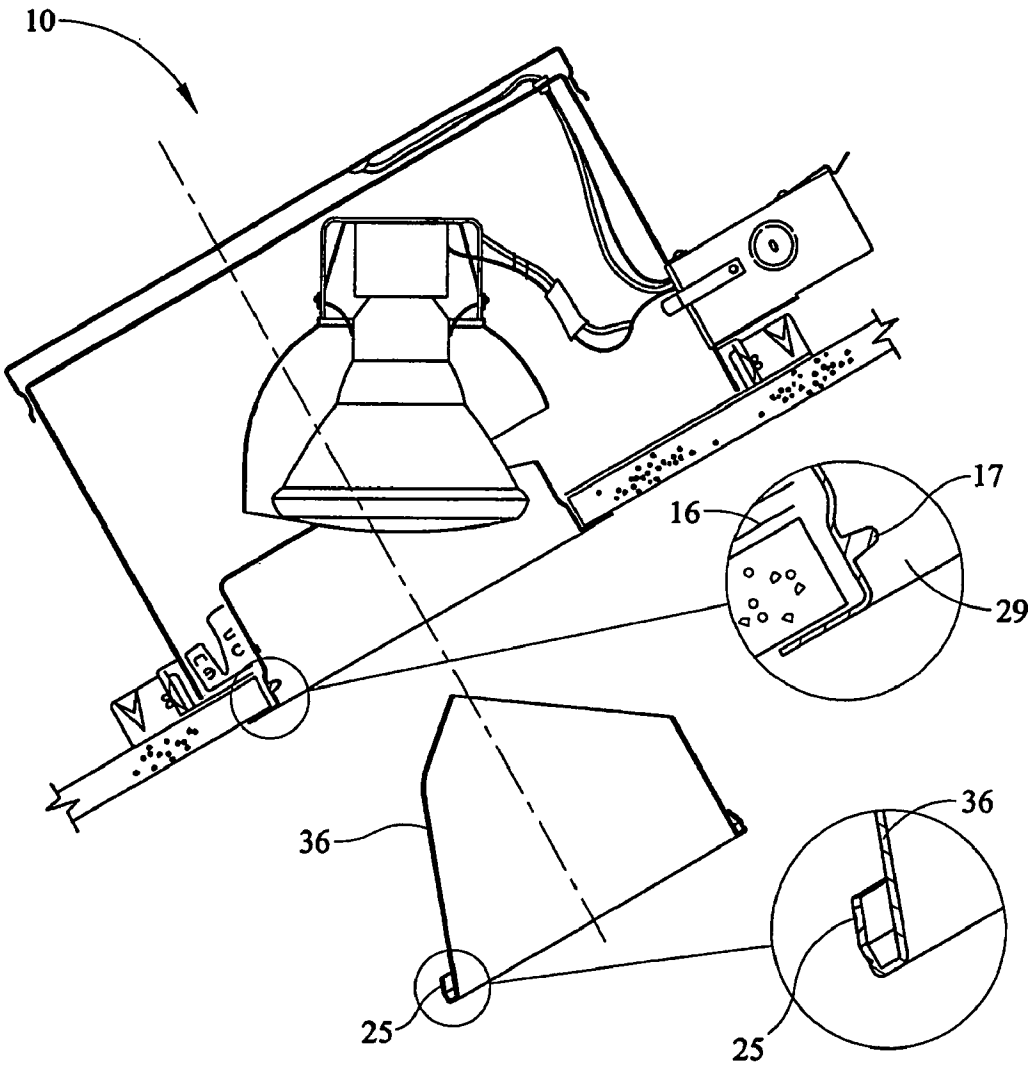
FIG. 2*a* is a side-sectional view with close-ups of the sloped ceiling recessed light fixture of the present invention with break out detailed close-ups.
Figure 2B:
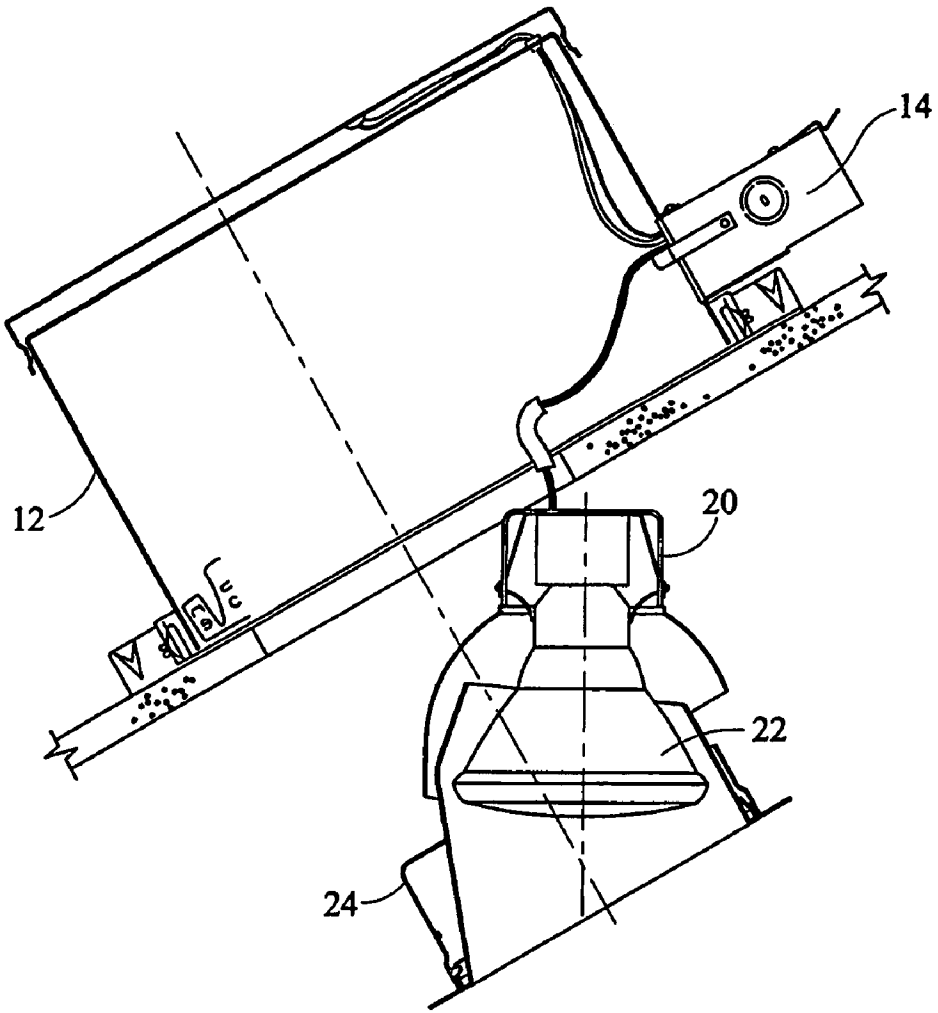
FIG. 2*b* is a side-sectional view of the sloped ceiling recessed downlight of the present invention during installation.

As shown in FIGS. 2*a* and 2*b*, in combination with the other figures, the cone or baffle 36 has a circumferentially extending edge or slot 25. The slot 25 is designed such that the cone may be installed directly within the trim 19. The baffle 36 fits into the interior of the trim 19 and the housing 12 over fitting the pan 16 which has a pan aperture 13 formed therein. The lower trim element 24 may have a defined circular side wall 29 with a lancing or mechanical connection member 17 formed thereon. The mechanical connection member 17 may be received within the slot 25 formed in the baffle 36 such that the cone or baffle is securely retained within the trim 19 and affixes in position for allowing relative rotational movement of the upper trim element 22. A plurality of the lancings 17 may be provided.

The two piece trim element 19 may be installed into the interior of the housing 12 through standard techniques, such as rotational mounting assemblies as are described in U.S. Pat. Nos. 4,313,154 and 4,327,403, the contents of which are incorporated herein by reference.

As shown in FIG. 2*b* and the other figures, the recessed downlight of the present invention has a socket cup 20 which is electrically connected to the junction box 14. The socket cup 20 retains the lamp 30 therein and may be affixed to the upper trim element 22 along the upper lip 21 shown in FIGS. 3*a* and 3*b*.

After connection of the socket cup 20 to the upper trim element 22, the lower trim element 22 and upper trim element 24 with the socket cup 20 attached may be installed into the interior of the housing 12 and directly affixed therein. The two piece trim element 19 may be inserted through the pan aperture 13 into the interior of the housing 12 and secured therein through a multiple of known securing techniques. However, it is desirable to have the securing of the two piece trim element 19 such that no interference occurs between the trim and its desired pivoting capabilities.

Figure 4A:
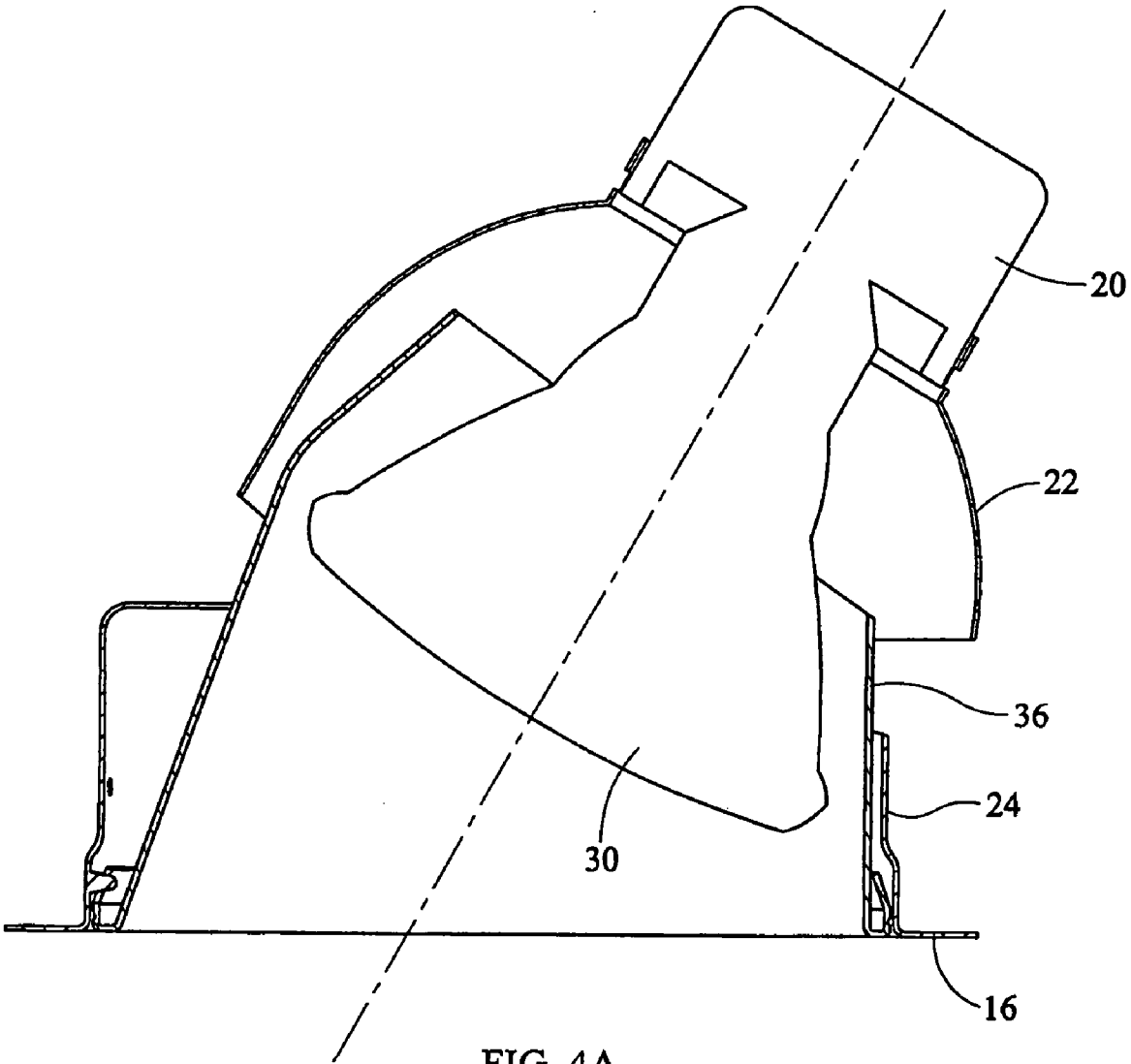
FIG. 4*a* is a side-sectional schematic view of the two piece trim and swivel mechanism of the present invention as installed.
Figure 4B:
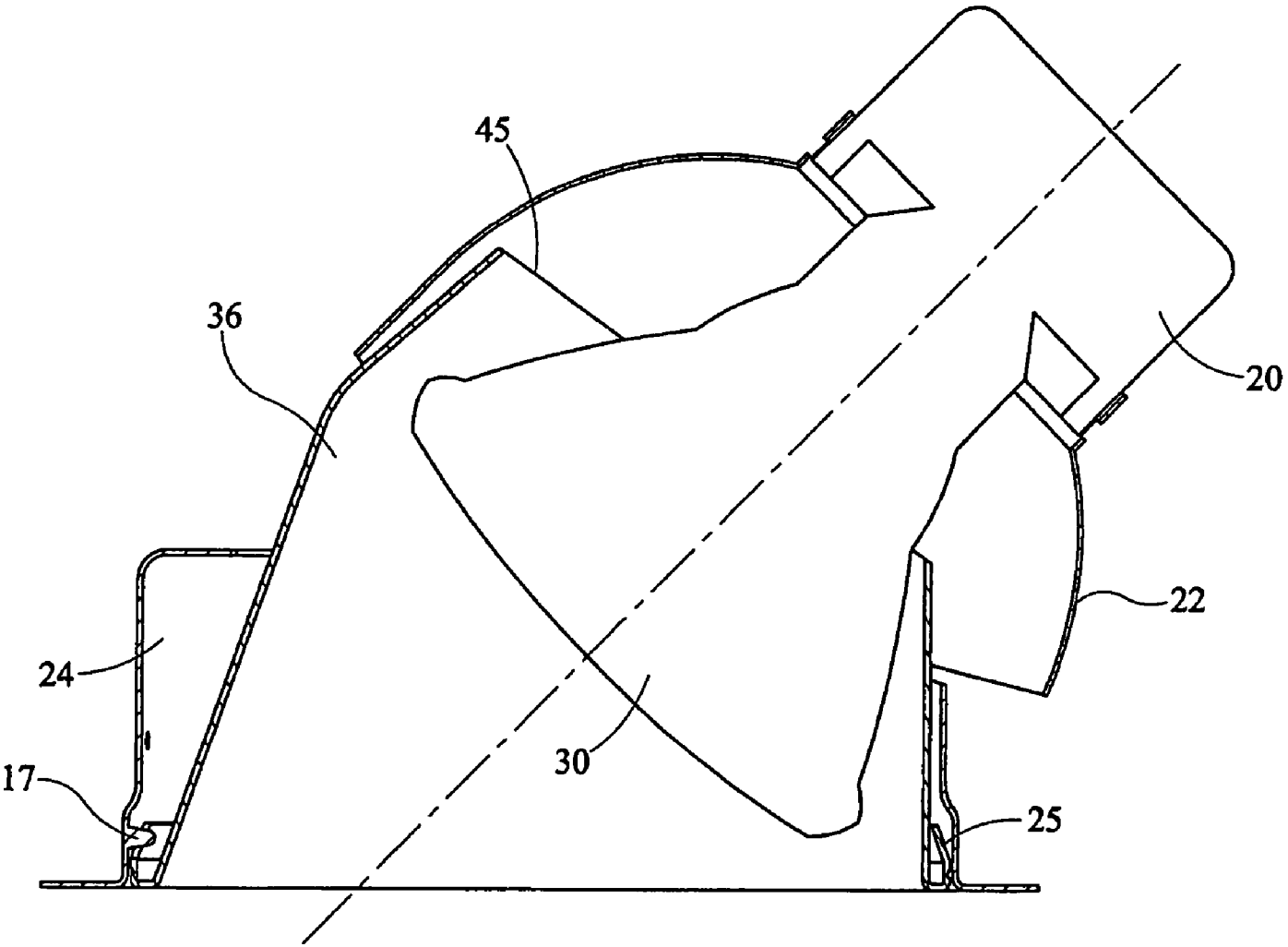
FIG. 4*b* is a side sectional view of the two piece trim with swivel mechanism of the present invention as installed.

Turning to the actual two piece rotatable trim design 19 of the present invention, as depicted in FIGS. 3A and 3B and FIGS. 5 and 6, the upper trim element 22 off-center pivots with the lower trim element 24. In order to accommodate such rotational pivot extent as set forth herein, the lower bevel edge 42 of the upper trim element 22 must be kept away from the upper bevel edge 41 of the lower trim element 24. In the two piece rotatable trim element 19 of the present design, the upper trim element 22 has a lower bevel edge 42 adjacent to an upper bevel edge 41 of the lower trim element 24. As a result, when the upper trim element 22 off-center pivots about the hinge point 26 of the lower trim element 24, the full extent of rotation may be allowed as shown in FIGS. 4A and 4B while also allowing the lower bevel edge 42 to rotate beyond the plane defined by the upper flat edge 43.

In other words, the design of the two piece rotatable trim 19 of the present invention allows a wide extent of rotation relative to the two elements of the trim 19 without them coming into interfering contact with each other. Thus, an angle of inclination as depicted in FIG. 4B is allowable when the ceiling and therefore the pan 16 is at a steep pitch. Such is desirable as the center beam of the lamp may be desired to be on a substantially vertical axis even though the ceiling is on a steep angle of inclination between and including about 3/12 and 12/12 pitch.

Located interior to the two piece rotatable trim 19 of the present invention is positioned a baffle 36 or other cone member. The baffle or cone member 36 may be installed using various techniques known in the art such that the baffle or cone is securely affixed into the interior of the two piece rotatable trim member 19 while properly shrouding the lamp 30 for appropriate direction of light and glare reduction. As can be appreciated from the design, the baffle or cone 36 is securely affixed to the lower trim member 24 and does not rotate with the upper trim member 22. Alternative designs for the baffle are readily available. Thus, as depicted in FIGS. 4*a* and 4*b*, the upper aperture 45 of the baffle or cone 36 may be wide enough to allow for rotation of the lamp 30 about the hinge 26. As is seen in FIGS. 4*a* and 4*b*, the design is adequate for ceiling slopes of anywhere between 10° and 50° and preferably between 14° and 45° in order to provide downlighting on the noted sloped ceiling. Consequently, the upper trim element 22 may be positioned from between 10° and 50° relative to the lower trim element 24 and preferably between 14° and 45°, the lower trim element matching the angle of inclination of the ceiling, in order to maintain the lamp along a vertical axis with the floor or lighted surface.

Although the present invention has been described in connection with preferred embodiments thereof, it will be appreciated by those skilled in the art that additions or modifications as well as substitutions to elements noted herein which are not specifically described may be made without departing from the spirit of scope of the invention as defined in the following claims.

I claim:

1. A sloped ceiling recessed downlight, comprising:

an enclosure mounted on a frame, said frame having an aperture formed therethrough;

a pivotable two piece trim member, said two piece trim member having a lower trim element and an upper trim element, said lower trim element pivotally connected directly to said upper trim element at a first and a second hinge point, said first and second hinge point positioned less than 180 degrees apart on said lower trim element to create an offset hinge.

2. The recessed downlight of claim 1 wherein said upper trim element is positioned relative to said lower trim element between 10 degrees and 50 degrees about said offset hinge.

3. The recessed downlight of claim 1 wherein said upper trim element has a lower bevel edge extending upward towards an upper lip.

4. The recessed downlight of claim 3 wherein said lower trim element has an upper bevel edge extending downward away from said upper trim element.

5. The recessed downlight of claim 1 wherein said upper trim element has a first and a second leg hingedly connected to an interior wall of said lower trim element.

6. A recessed downlight for installation on a slope ceiling having a pivotable trim, comprising:

a removable two piece rotatable trim element, said rotatable trim element having an upper trim element and a lower trim element, said upper trim element hingedly connected to said lower trim element on a rotation axis which crosses said lower trim element, said rotation axis offset from a bisecting axis of said lower trim element;

said removable two piece trim fitting within a housing mounted on a frame;

said upper trim element removably attached to a socket cup, said socket cup retaining a lamp and electrically connected to a junction box.

7. The recessed downlight of claim 6 wherein said upper trim element has a lower bevel edge extending from a first and second leg upward toward an upper lip and said lower trim element has an upper bevel edge extending away from said upper trim element.

8. A modular adjustable two piece trim for insertion into a recessed downlight on a sloped ceiling, comprising:

a two piece rotatable trim element having an upper trim element hingedly connected to a lower trim element, said two piece rotatable trim element fitting within a recessed downlight housing, said upper trim element hingedly connected to said lower trim element along an offset hinge axis and wherein hinge connections are spaced apart less than 180 degrees.

9. The modular two piece trim of claim 8 wherein said offset hinge axis extends through said lower trim at positions along an arc of about 155° based from a center point of said lower trim element.

10. The recessed downlight of claim 8 wherein said lower trim element has an upper bevel edge extending downward away from said upper trim element, and said upper trim element has a lower bevel edge extending upward away from said lower trim element, said upper bevel edge and said lower bevel edge beginning at a point adjacent to said hinge between said lower trim element and said upper trim element.

11. A recessed ceiling frame in kit, comprising:

a pan affixed to a housing forming an enclosed space interior of said housing, said pan having an aperture, said housing having a socket cup located therein electrically connected to a junction box;

an upper trim element and a lower trim element, said upper trim element mechanically connected to said socket cup;

wherein said first trim element and said second trim element are connected at an offset pivot point to allow relative rotation of 10 degrees and 50 degrees rotation without mechanical fasteners to said housing, said lower trim element securely affixed to said pan.

12. A two piece sloped ceiling trim for insertion into a recessed downlight housing, comprising;

an upper trim element hingedly connected to a lower trim element along an offset pivot point, said lower trim element affixed to a recessed downlighting frame, said frame supporting said lower trim element and a housing;

said upper trim element pivotable relative to said lower trim element between 10° and 50°;

the socket cup mechanically affixed to said upper trim element and electrically connected to a junction box;

said upper trim element having a cut-away section forming a lower bevel edge; said lower trim element having a cut-away section forming an upper bevel edge, said upper bevel edge opposite said lower bevel edge.

13. A trim for sloped ceiling installation within a housing behind the sloped ceiling, comprising:

a modified hemispherical section surrounding at least a portion of a lamp, said modified hemispherical section having a first and a second hinge point;

a cylindrical member rotatably affixed to said modified hemispherical section at said first and said second hinge point, such that said modified hemispherical section rotates about said first and said second hinge point to frictionally position said lamp at an angular disposition to said cylindrical member; said first and second hinge points being spaced apart less than 180 degrees said cylindrical member defining an offset hinge.

14. The trim of claim 13 wherein said cylindrical member has a first and a second flat segment adjacent said first and said second hinge point of said modified hemispherical section.

15. The trim of claim 14 wherein said modified hemispherical section is hingedly connected to said cylindrical member on an interior wall of said cylindrical member.

16. The trim of claim 13 wherein said modified hemispherical section has a first and a second depending leg formed by a lower bevel edge on said modified hemispherical section.

17. The trim of claim 16 wherein said cylindrical member has an upper bevel edge adjacent said lower bevel edge on said modified hemispherical section to allow said modified hemispherical section to swivel about said first and said second hinge point from about 10 degrees to about 50 degrees.

* * * * *